US007314093B2

(12) United States Patent
Orr

(10) Patent No.: US 7,314,093 B2
(45) Date of Patent: Jan. 1, 2008

(54) FAST RESPONSE SPRINKLER ASSEMBLY FOR A FIRE EXTINGUISHING SYSTEM

(75) Inventor: Shawn G. Orr, Grand Rapids, MI (US)

(73) Assignee: The Viking Corporation, Hastings, MI (US)

( * ) Notice: Subject to any disclaimer, the term of this patent is extended or adjusted under 35 U.S.C. 154(b) by 350 days.

(21) Appl. No.: 11/056,797

(22) Filed: Feb. 11, 2005

(65) Prior Publication Data

US 2005/0178564 A1 Aug. 18, 2005

Related U.S. Application Data

(60) Provisional application No. 60/682,886, filed on Feb. 12, 2004.

(30) Foreign Application Priority Data

Feb. 18, 2004 (CA) ..... 2458421

(51) Int. Cl.
*A62C 37/08* (2006.01)
*A62C 37/36* (2006.01)
*B05B 1/26* (2006.01)

(52) U.S. Cl. ..... 169/37; 169/16; 169/17; 169/41; 169/42; 239/518; 239/522; 239/524

(58) Field of Classification Search ..... 169/37, 169/41, 42, 16, 17; 239/518, 522, 523, 524, 239/498

See application file for complete search history.

(56) References Cited

U.S. PATENT DOCUMENTS 0,250,912 A 12/1881 Grinnell
0,269,197 A 12/1882 Grinnell
0,316,581 A 4/1885 Stratton
0,329,311 A 10/1885 Hill
0,452,081 A 6/1891 Pierce
0,637,687 A 11/1899 Weston
0,729,306 A 5/1903 Evans
1,028,940 A 6/1912 Hunter
1,220,025 A 3/1917 Taylor
1,285,133 A 11/1918 Gross
1,286,333 A 12/1918 Johnson
2,135,138 A 11/1938 Kendall ..... 299/18
2,357,227 A 8/1944 Rowley
2,550,456 A 4/1951 De Flon
2,591,872 A 4/1952 Rider (Continued)

*Primary Examiner*—Davis D. Hwu
(74) *Attorney, Agent, or Firm*—Harness, Dickey & Pierce, P.L.C.

(57) ABSTRACT

A fast response residential sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to seal the outlet and release the seal when a temperature associated with a fire condition is detected. In addition, the sprinkler body is configured such that a ratio of the flow in gallons per minute from the outlet divided by the square root of the pressure in pounds per square inch gauge of the fluid supplied to the inlet is in a range of 4 to 6.

1 Claim, 5 Drawing Sheets

U.S. PATENT DOCUMENTS

| | | | | |
|---|---|---|---|---|
| 3,161,236 | A | 12/1964 | MaCartney | |
| 3,195,647 | A | 7/1965 | Campbell et al. | |
| 3,336,984 | A | 8/1967 | MaCartney | |
| 3,682,251 | A | 8/1972 | Livingston | |
| 3,716,103 | A | 2/1973 | Tanaka et al. | |
| 3,866,686 | A | 2/1975 | Goodsell, Jr. et al. | |
| 3,874,456 | A | 4/1975 | Gloekler | |
| 3,888,313 | A | 6/1975 | Freeman | |
| 3,918,645 | A | 11/1975 | Mohler | |
| 4,273,195 | A | 6/1981 | Fischer et al. | |
| 4,279,309 | A | 7/1981 | Fischer et al. | 169/37 |
| 4,580,729 | A | 4/1986 | Pounder | |
| 4,609,047 | A | 9/1986 | Pieczy Kolar | |
| 4,623,023 | A | 11/1986 | Retzloff et al. | |
| 4,624,414 | A | 11/1986 | Ferrazza | |
| 4,732,216 | A | 3/1988 | Polan | |
| 4,739,835 | A | 4/1988 | Polan et al. | |
| 4,757,865 | A | 7/1988 | Simons | |
| 4,893,679 | A | 1/1990 | Martin et al. | |
| 4,901,799 | A | 2/1990 | Pepi et al. | |
| 4,930,578 | A | 6/1990 | Barnett et al. | |
| 5,010,959 | A | 4/1991 | Lostoski | |
| 5,366,022 | A | 11/1994 | Meyer et al. | |
| 5,579,846 | A | 12/1996 | Meyer et al. | 169/37 |
| 5,628,367 | A | 5/1997 | Truax et al. | 169/37 |
| 5,829,532 | A | 11/1998 | Meyer et al. | 169/37 |
| 5,839,667 | A | 11/1998 | Fischer | 239/498 |
| 5,862,994 | A | 1/1999 | Pounder | 239/498 |
| 5,865,256 | A * | 2/1999 | Pounder | 169/37 |
| 5,865,265 | A | 2/1999 | Pounder | 169/37 |
| 6,026,907 | A | 2/2000 | Pahila | 169/37 |
| 6,059,044 | A | 5/2000 | Fischer | 169/37 |
| 6,336,509 | B1 | 1/2002 | Polan et al. | 169/37 |
| 6,450,265 | B1 * | 9/2002 | Ponte | 169/37 |

* cited by examiner

FAST RESPONSE SPRINKLER ASSEMBLY FOR A FIRE EXTINGUISHING SYSTEM

This application claims priority from U.S. provisional application Ser. No. 60/682,886, filed on Feb. 12, 2004, entitled FAST RESPONSE SPRINKLER ASSEMBLY FOR A FIRE EXTINGUISHING SYSTEM, by Applicant Shawn G. Orr, which is incorporated herein by reference in its entirety.

BACKGROUND OF THE INVENTION

The present invention relates to a sprinkler and more particularly to an automatic residential sprinkler.

Automatic sprinklers have long been used to disperse a fluid to control a fire. Typically, the fluid utilized in such systems is water; although systems have also been developed to disburse foam and other materials. Historically, sprinkler assemblies include a solid metal base connected to a pressurized supply of water and a deflector that is used to disperse the water flow. The deflector is typically spaced from the outlet of the base by a frame. A trigger assembly is mounted between the base and a seal, which is positioned over the orifice of the base, to hold the seal in place over the orifice to thereby seal the orifice. When the temperature surrounding the sprinkler assembly is elevated to a temperature associated with a fire condition, the trigger assembly releases the seal and water is allowed to flow from the orifice of sprinkler assembly.

"Fast" sprinkler assemblies are those sprinkler assemblies that deliver fire suppressant over a shorter response time than standard sprinklers. A measurement of a sprinkler's response time is referred to as a reaction time indices ("RTI"), which for fast sprinklers is typically less than 100 $m^{1/2}sec^{1/2}$. For residential sprinklers, the current standards specify a maximum RTI of 50.

SUMMARY OF THE INVENTION

The present invention provides a fast sprinkler assembly that can achieve the desired minimum flow rates for residential sprinklers but at reduced water supply pressures that heretofore known.

In one form of the invention, the sprinkler assembly of the present invention includes a sprinkler head body configured for attachment to a fire extinguishing fluid supply line. The sprinkler head body is formed with an orifice in fluid communication with the fire extinguishing fluid supply line, and has a K value in a range of about 4 to 6 and, more preferably, in a range of about 4.9 to 5.6, and, most preferably about 5.2. A trigger assembly, which is coupled to the sprinkler head body, exerts a sealing force upon a sealing assembly. It has been found that providing a residential sprinkler head body with a K value of about 4 to 6 and, more preferably, in a range of about 4.9 to 5.6, and, most preferably about 5.2 results in a fast response sprinkler assembly that provides minimum flows using lower pressures that heretofore known that is particularly suitable for use as a residential sprinkler where suppression and/or extinguishment of a fire is required.

According to one form of the invention, a sprinkler assembly includes a sprinkler body having a base and a frame extending from the base. The base has a passage extending therethrough defining an inlet and an outlet. A deflector is mounted to the frame and spaced from the outlet, which is configured to deflect fluid flowing from the outlet in a radial pattern. A trigger assembly extends between the frame and the base and is adapted to seal the outlet and release the seal when a temperature associated with a fire condition is detected. The sprinkler body is configured such that a ratio of the flow in gallons per minute from the outlet divided by the square root of the pressure in pounds per square inch gauge of the fluid supplied to the inlet is in a range of about 4 to 6 and, more preferably, in a range of about 4.9 to 5.6, and, most preferably, about 5.2.

In one aspect, the deflector includes a plurality of slots having varying dimensions. For example, the deflector includes a generally planar member having a perimeter with the slots extending into the plane of planar member from its perimeter.

In a further aspect, each slot has a depth measured from the perimeter of the planar member. Preferably, the depths of the slots vary. For example, the depths may alternate between a first depth and a second depth, with the first depth being greater than the second depth.

In a further aspect, the planar member is circular, with the slots arranged such that their longitudinal axes align on respective radii of the planar member. For example, the slots may be arranged so that the longer slots align along radii extending through 0 degrees, 90 degrees, 180 degrees, and 270 degrees. In preferred form, the arms of the frame are aligned with a pair of the longer slots. The number of slots may vary. For example, the deflector may include twelve long slots and twelve shorter slots.

The present invention provides a fast response sprinkler assembly capable of discharging a sufficient output of water or other fire extinguishing fluid, and effectively alters the trajectory of the water so as to develop a spray distribution pattern about a pre-selected area using minimum flows and lower pressures than heretofore known.

These and other features and advantages of the present invention will be further understood and appreciated by those skilled in the art by reference to the following specification, claims, and drawings.

DETAILED DESCRIPTION OF PREFERRED EMBODIMENTS

Figure 1:
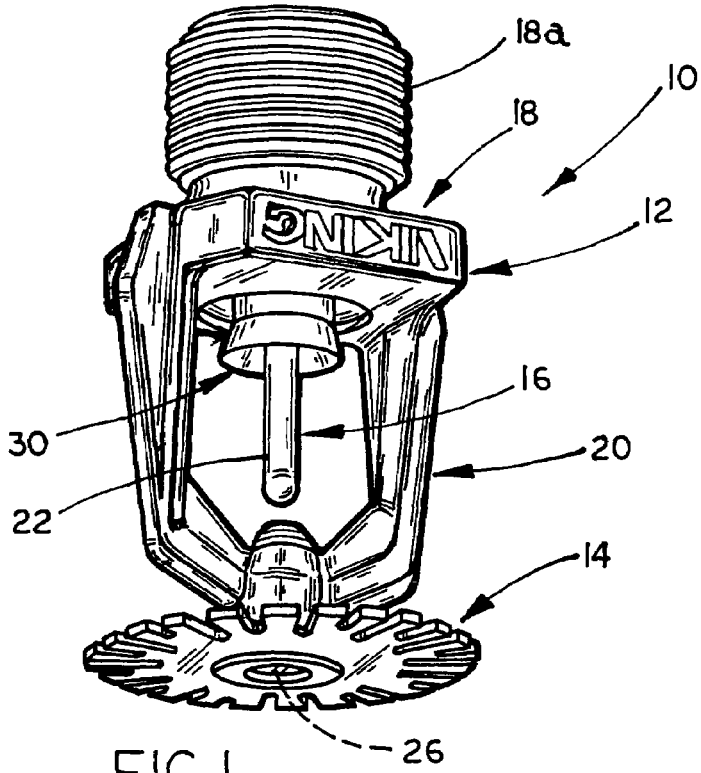
FIG. 1 is a perspective view of a fast response sprinkler assembly of the present invention.
Figure 2:
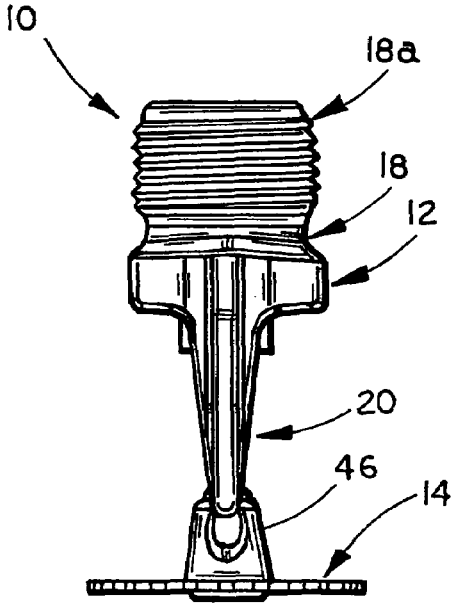
FIG. 2 is side elevation view of the sprinkler assembly depicted in FIG. 1.

Referring to FIG. 1, the numeral 10 generally designates a sprinkler assembly of the present invention. As will be more fully described below, the sprinkler assembly comprises a fast response sprinkler assembly that generates a sufficient flow rate of water during the initial stage of fire development and develops an optimum spray distribution pattern capable of delivering an actual delivered density in excess of the required delivered density for a given fuel package to thereby permit a fire to be suppressed or extinguished. Although the sprinkler head of the present invention may be used to protect any area, it is particularly suited for use within a residential area where the ceilings are substantially smooth, flat, and horizontal.

As best seen in FIG. 1, sprinkler assembly 10 includes a sprinkler body 12, a deflector 14, and a trigger assembly 16. Body 12 includes a base 18 and a frame 20 to which deflector 14 is mounted. Base 18 includes an externally threaded portion 18*a*, which allows sprinkler body 12 to be threaded onto a fire extinguishing fluid supply line or pipe.

In the illustrated embodiment, trigger assembly 16 includes a frangible bulb 22, which extends between base 18 and frame 20 and which is held in place and further urged toward outlet opening 24 of base 18 by a compression screw 26 to thereby maintain the seal on the outlet opening 24, which when opened enables the flow of fire extinguishing fluid through base 18, as will be more fully described below. Most preferably, for a ½ "NPT sprinkler assembly, opening 24 is in a range of about 0.40 to 0.50 and, more typically, in a range of about 0.420 to 0.426 inches in diameter.

Figure 3:
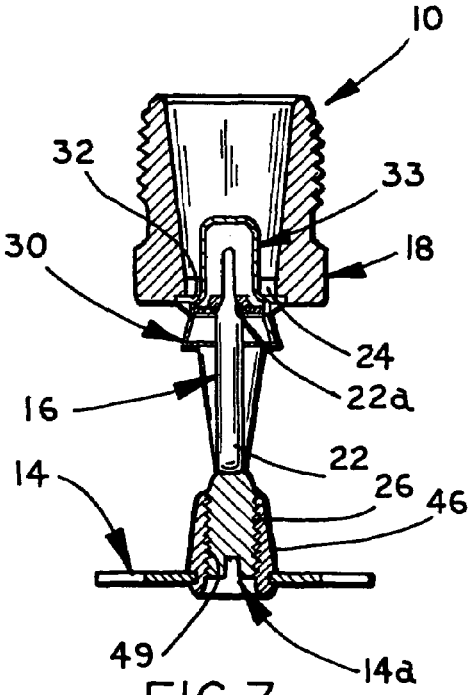
FIG. 3 is a sectional view of the sprinkler assembly taken along line III-III of FIG. 2.

As best seen in FIG. 3, bulb 22 is seated and held in outlet opening 24 by a bulb holder 30, which in turn urges a ring-shaped or annular spring seal 32 to seal outlet opening 24 under the force of the bulb. Referring to FIGS. 5-9, bulb holder 30 comprises a cup-shaped member 33 with an annular rim 34 for receiving an annular insert 36. Insert 36 includes a central opening 36*a* that is sized to receive the lower end of bulb 22, which has a narrowed cross-section to form a shoulder 22*a* (FIG. 3) in the bulb, but sized small enough so that shoulder 22*a* rests on insert 36 so that bulb 22 is supported in cup-shaped member 33 by insert 36.

Figure 9:
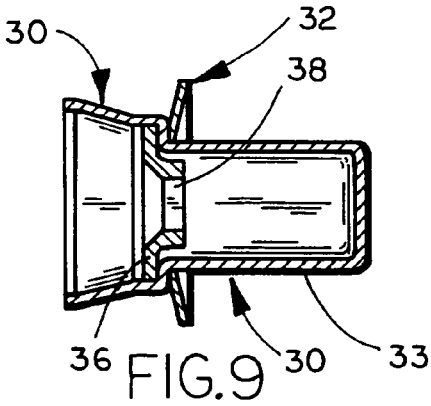
FIG. 9 is a similar view to FIG. 7 with the spring seal mounted to the bulb holder.

Positioned around cup-shaped member 33 is spring seal 32, which seals opening 24 when compressed against base 18 by cup-shaped member 33. In an uncompressed state, spring seal 32 assumes a convex configuration (FIG. 9). When compressed, however, spring seal 32 has a generally planar configuration (FIG. 3). Spring seal 32 is preferably formed form a spring metal, such as nickel alloy, and, further, is coated with Teflon tape, which provides a seal. In this manner, when the compression force is released from spring seal 32, spring seal 32 will return to its convex configuration and generate a force to push bulb holder 30 away from outlet opening 24, which reduces the chances of the bulb holder interfering with the flow of fire extinguishing fluid from opening 24.

Figure 10:
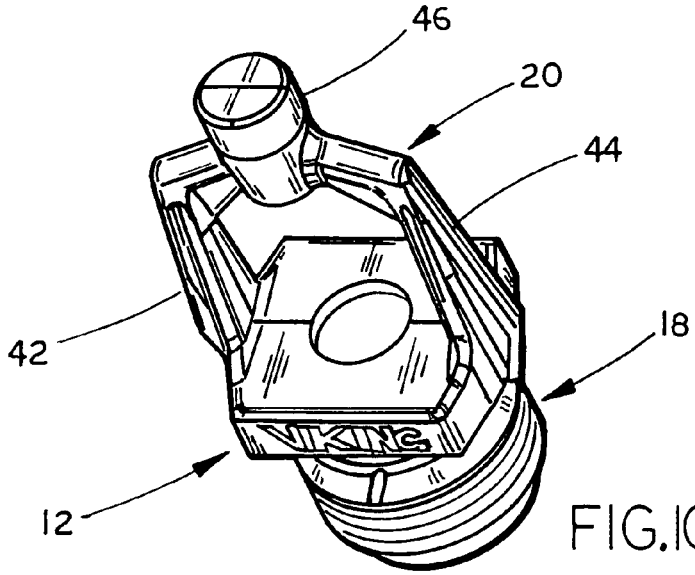
FIG. 10 is a perspective view of the sprinkler head body of the sprinkler assembly with the deflector and trigger assembly removed.
Figure 11:
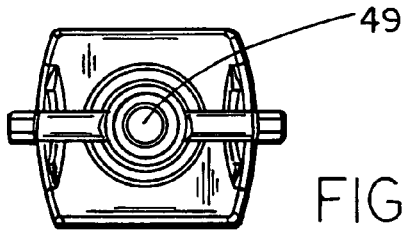
FIG. 11 is a plan view of the sprinkler head body of FIG. 10.
Figure 12:
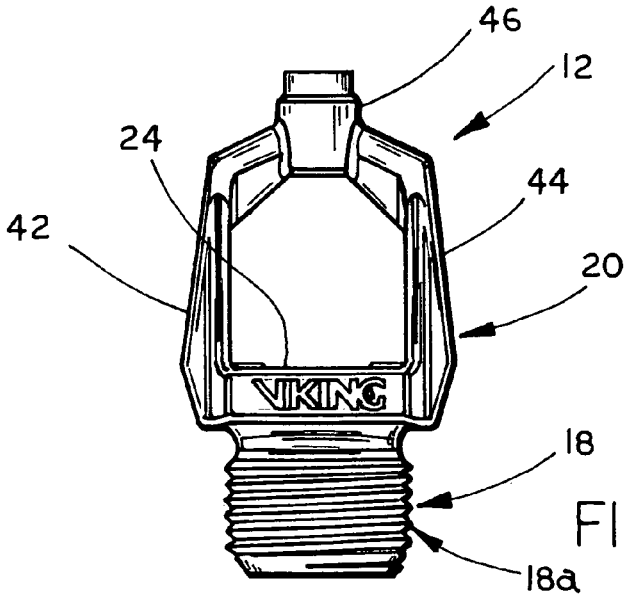
FIG. 12 is a side view of the sprinkler head body of FIG. 10.

As noted above, deflector 14 is mounted to frame 20. As best seen in FIG. 10-12, frame 20 includes a pair of frame arms 42 and 44 that extend from base 18. Frame arms 42 and 44 comprise generally L-shaped arms that are joined at their respective ends by a central boss 46. Boss 46 includes an internally threaded aperture or bore 49 (FIGS. 3 and 11) through which compression screw 26 is threaded to engage and compress bulb 22 against bulb holder 30. In order to permit sprinkler body 20 to deliver an appropriate quantity of fire extinguishing fluid during the initial stages of fire development, bulb 22 preferably has a trigger temperature—that is a temperature at which the bulb explodes—between approximately 145° F. and 165° F., more preferably, between approximately 149° F. and 161° F., and, most preferably, approximately 155° F.

Figure 4:
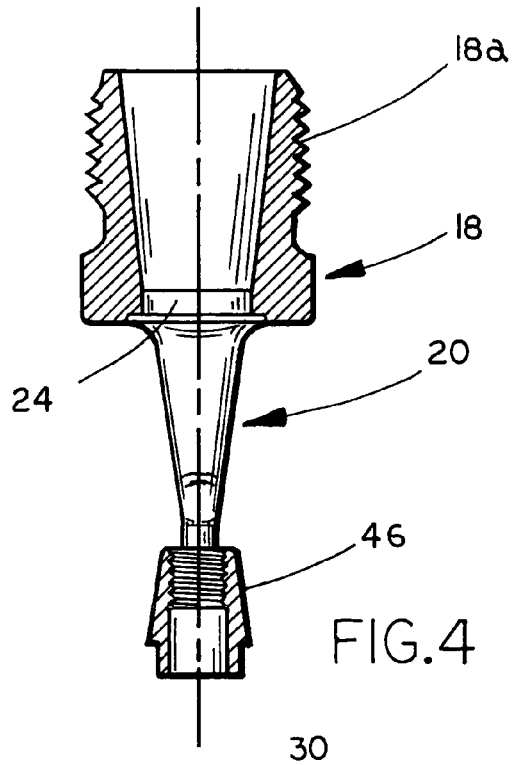
FIG. 4 is a sectional view of the sprinkler assembly taken along line IV-IV of FIG. 2.
Figure 5:
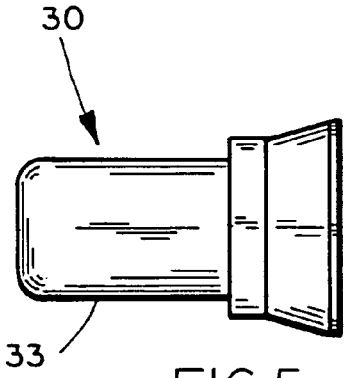
FIG. 5 is an enlarged side view of the bulb holder of the trigger assembly.
Figure 6:
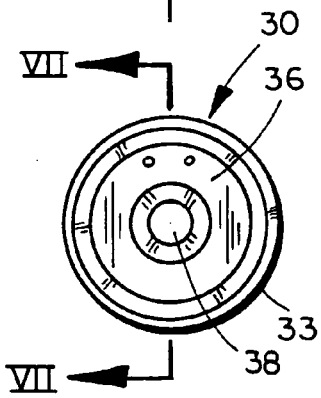
FIG. 6 is top plan view of the bulb holder of FIG. 5.
Figure 7:
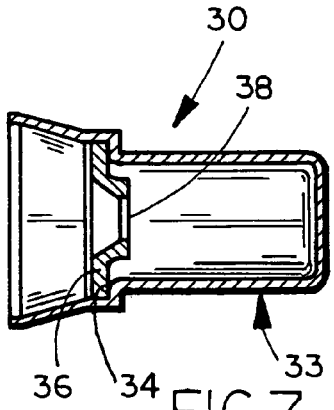
FIG. 7 is a sectional view taken along line VII-VII of FIG. 6.
Figure 8:
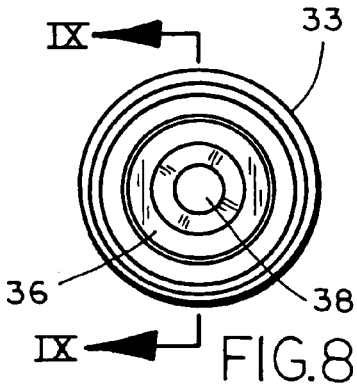
FIG. 8 is a similar view to FIG. 6 with the spring seal mounted to the bulb holder.

Referring to FIGS. 13-16, deflector 14 is formed from a generally planar, circular member 50. For example, planar member 50 may a have a thickness in a range of 0.04 to 0.06 inches, more typically, in a range of 0.045 to 0.055 inches and, most typically, for a ½ NPT sprinkler, has a thickness of about 0.05 inches. Referring to FIG. 4, planar member 50 of deflector 14 is formed with a central aperture 50*a*, such as a double hex opening, to attach deflector 14 to boss 46.

To disperse the fire extinguishing fluid in the desired spray pattern, a plurality of spaced slots 52 are formed at the perimeter of member 50, which extend into member 50 from its outer perimeter edge 50*b*. In other words, the slots extend into member 50 so that they extend in and are arranged in the plane of member 50. Each slot 52 has parallel sides 52*a* that extend into planar member 50 and terminate in a radiused end 52*b*. Slots 52 may be uniform having uniform depths and radii of curvature at their respective ends or may be varied. For example, in the illustrated embodiment, the depths of the slots vary. For example, the depths may alternate between a first depth, a second depth, and a third depth with the first depth being greater than the second or third depths to define long slots 54. And, the second depths are greater than third depths to define short slots 55 and 56.

Further the radii of curvature of ends 52*b* may vary. For example, the depth of long slots 54 may fall in a range of about 0.18 to 0.3 inches, more typically in a range of about 0.20 to 0.28 inches, and most typically, in a range of about 0.22 to 0.24 inches. For example, for a 1¼ inch diameter deflector, the length of long slots may vary as noted but, more typically, fall in a range of about 0.22 to 0.24 inches and, most typically, approximately 0.23 inches. The depth of short slots 55 may fall in a range of about 0.08 to 0.16 inches, more typically, in a range of about 0.10 to 0.14 inches, and, most typically, in a range of about 0.11 to 0.13 inches. Similarly, for a 1¼ inch diameter deflector, the length of the short slots 55 will most typically be about 0.125 inches. The depth of slots 56 may fall in the range of about 0.14 to 0.24 inches, more typically, about 0.15 to 0.19 inches, most typically, about 0.16 to 0.18 inches. For a 1¼ inch diameter deflector, the length of slots 56 will most typically be about 0.17 inches. In addition, the radii of curvature ends 52*b* may vary. For example, the radii of curvature ends 52*b* may fall in a range of about 0.025 to 0.040 inches, more typically, in a range of about 0.028 to 0.038 inches, and most typically, in a range of about 0.03 to 0.035 inches.

Figure 13:
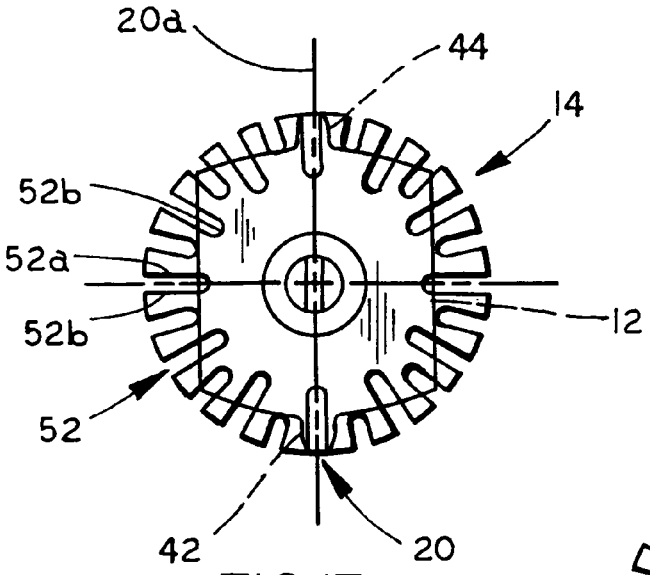
FIG. 13 is plan view of the deflector mounted to the sprinkler head body.

In a further aspect, the planar member is circular, with the slots arranged such that their longitudinal axes align on respective radii of the planar member. For example, the slots may be arranged so that the longer slots align along radii extending through 0°, 90°, 180°, and 270°, as measured from one of the frame arms. In this manner, a pair of slots aligns with the frame arms (FIG. 13). In preferred form, the arms of the frame are aligned with a pair of the longer slots. In addition, the number of slots may vary. For example, the deflector may include twelve long slots and twelve short slots. Further, each slot has a lateral dimension extending generally perpendicular to its respective radius of the circular member—one group of the slots may have smaller lateral dimensions than another group of the slots.

In another aspect, the radii of curvature of the slots located at 90° radius and 270° radius—in other words, the slots that extend along an axis orthogonal to the axis 20*a* (FIG. 13) that extends between the frame arms—have smaller radii of curvature that the slots aligned with the frame arms and, further, smaller than the slots arranged there between.

Figure 15:
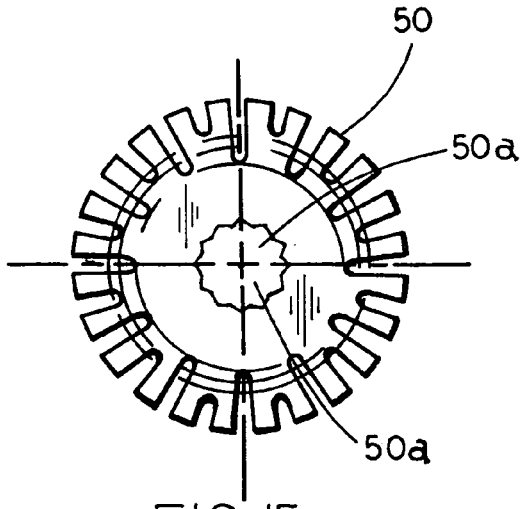
FIG. 15 is similar view to FIG. 14.
Figure 14:
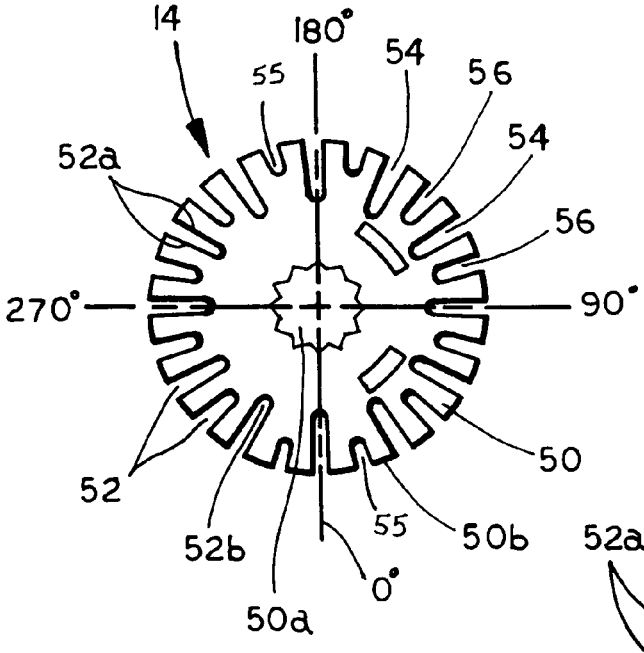
FIG. 14 is a plan view of the deflector.
Figure 16:
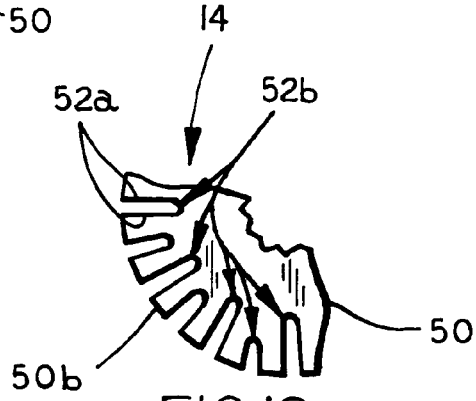
FIG. 16 is partial fragmentary plan view of the deflector.

Referring to FIG. 15, the radiused ends of the long slots are arranged to align with an inner diameter of member 50. For example, ends 52*b* of slots 54 are aligned along a diameter in a range of about 0.75 to 0.83 inches, more typically, in a range of about 0.76 to 0.82 inches, and, most typically, in a range of about 0.78 to 0.80 inches. Ends 52*b* of slots 56 may be aligned along a diameter in a range of about 0.7 to 1.2 inches, more typically, in a range of about 0.8 to 1.1 inches, and most typically, in a range of about 0.85 to 0.95 inches. Most typically, the ends of slots 56 may be aligned along a diameter of about 0.9 inches. In this manner, the central portion of deflector 14 has a continuous circular surface having a diameter in a range of about 0.75 to 0.83 inches, and most typically in a range of about 0.78 to 0.80 inches.

Sprinkler assembly 10 is configured to have a discharge coefficient or "K value" (which is the measurement of the flow of water in gallons per minute through the sprinkler head divided by the square-root of the water pressure delivered to the sprinkler in pounds per square inch gauge) of between approximately 4 and 6, and preferably, approximately 5.2. It has been found that discharge coefficients of 5.6 and greater do not often achieve the desired minimum flow rates. In addition, it has been sprinklers with K factors of less than 4.9 may achieve the desired minimum flow rates but only at larger pressures. Discharge coefficient or K factor of a sprinkler is determined by flow testing. For example, the flow testing in increments of pressure from an initial pressure measurement and then decreased in the same increments back to the original pressure value. The K value then is determined from the actual flow in gallons per minute divided by the square-root of the pressure of the supplied water and psig at each increment, which are then averaged from all the incremental values which determines the K factor of the sprinkler.

As noted above, sprinkler assembly 10 is a fast response sprinkler. The response time of a sprinkler is referred to as "RTI", which is a measure of thermal-sensitivity of a sprinkler. RTI is the product of the thermal time constant of the trigger in units of seconds times the square-root of the velocity of the gas across the trigger. Fast response sprinklers have a RTI typically less than 100 $m^{1/2}sec^{1/2}$. As noted above, sprinkler assembly 10 has a K factor in a range of about 4 to 6 and, more preferably, in a range of about 4.9 to 5.6, and, most preferably about 5.2. Further, sprinkler assembly 10 has an RTI in a range of about 33 to 50 and, more preferably, of less than about 38. Sprinkler 10 with a K factor between about 4 and 6 will supply about 20 gpm at a flow pressure of about 25 psi. Sprinkler 10 with a K factor of 5.2 will supply 20 gpm at just under 15 psi. In this manner, the sprinkler on the present invention provides greater flow for less pressure than heretofore known. Therefore, in Applicant's invention, a sprinkler of the present invention provides an optimally-sized sprinkler for residential use that will be able to cover the areas with the volume and flow pressure noted in the table provided below. This K value, in combination with deflector 30, enables sprinkler assembly 10 to produce large, high momentum water droplets in a hemispheric pattern below deflector 30. The size and momentum of the water droplets permits penetration of the fire plume and direct wetting of the fuel package surface in order to successfully suppress or extinguish a fire.

Furthermore, sprinkler assemblies 10 is preferably mounted such that deflector 14 is located ¾ inches to 4 inches below a ceiling, which is preferably substantially smooth, flat and horizontal. The area of coverage for a given flow and pressure are listed below:

| Maximum Areas of Coverage | Minimum Water Supply Requirements |
|---|---|
| 12' × 12' | 14 gpm @ 7.2 psi |
| 14' × 14' | 14 gpm @ 7.2 psi |
| 16' × 16' | 14 gpm @ 7.2 psi |
| 18' × 18' | 17 gpm @ 10.7 psi |
| 20' × 20' | 20 gpm @ 14.8 psi |

Figure 17:
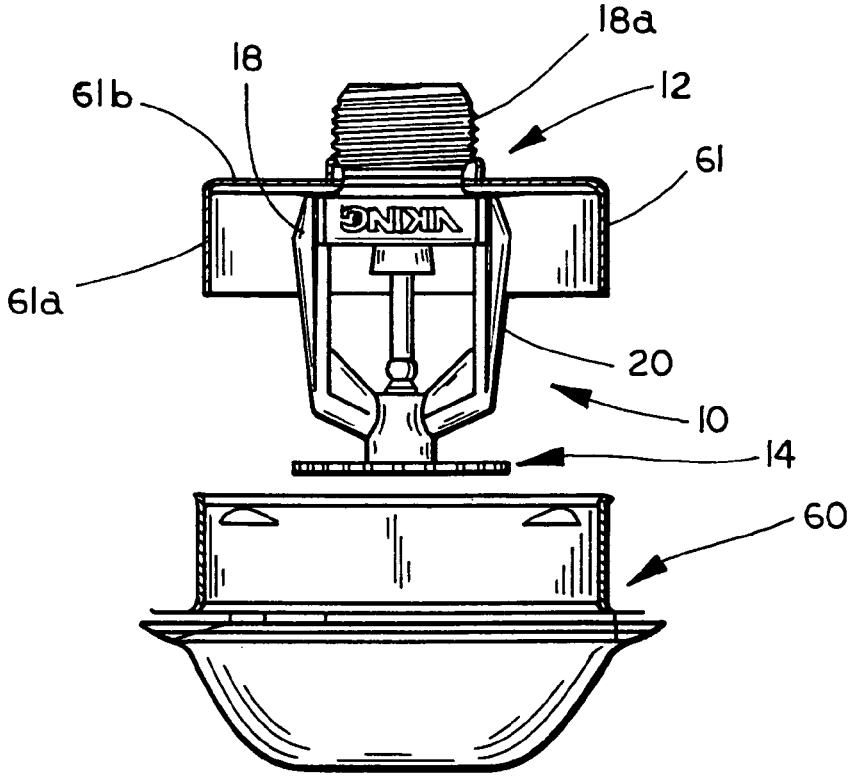
FIG. 17 is a partial exploded view of the sprinkler assembly of the present invention incorporating a cover assembly.
Figure 18:
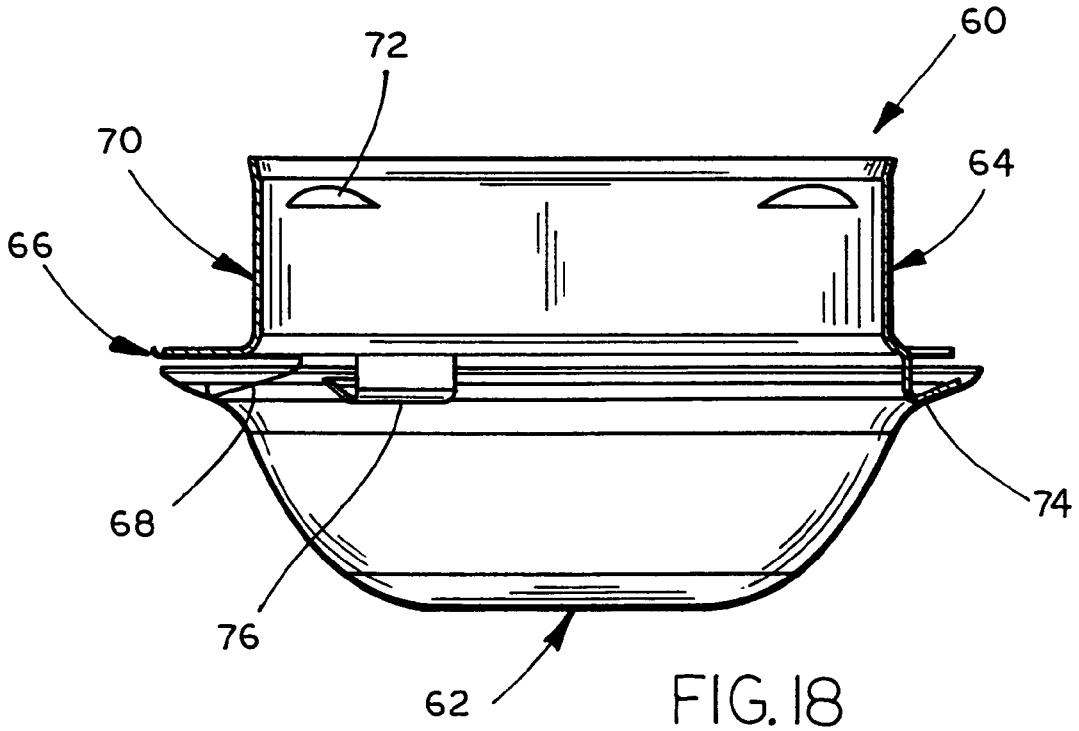
FIG. 18 is an enlarged elevation view of the cover assembly of FIG. 17.

Referring to FIGS. 17 and 18, sprinkler 10 may be installed as a concealed sprinkler, with a cover assembly 60 mounted over the deflector and over frame 20 of sprinkler assembly 10. When mounted as a concealed sprinkler, sprinkler body 12 includes an adapter member 61, which is mounted to the threaded portion 18*a* of base 18. Adapter 61 provides a mounting surface for cover assembly 60 as will be more fully described below.

As best seen in FIG. 18, cover assembly 60 includes a base 64 and a cover 62. Cover 62 is mounted to an annular rim 66 of base 64 by at least one of spring 68. Adapter member 61 comprises an annular cup-shaped member with a downwardly depending annular wall 61*a* and an upper generally horizontal annular wall 61*b*, which threads onto the threaded portion 18*a* of base 18. Base 64 of cover assembly 60 includes an annular wall 70 with a plurality of inwardly projecting tabs 72, which engage annular wall 61*a* and mount cover assembly 60 to adapter 61 to thereby position cover 62 over deflector 14 and the lower portion of frame 20.

Cover 62 generally has a bell-shaped configuration with an outwardly extending rim 74 which extends over and covers annular flange 66 of base 64 and, further, provides a contact point for downwardly depending tabs 76 of base 64. Similarly, rim 74 provides a contact point for spring 68, which has a generally V-shaped cross-section with a lower portion of spring 68 compressing against rim 74 and the upper portion of spring 68 engaged with rim 66 of base 64 to thereby releasably couple cover 62 to base 64.

While several forms of the invention have been shown and described, other forms will now be apparent to those skilled in the art. Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

The invention claimed is:

1. A fast response residential sprinkler assembly comprising: a sprinkler body having a base and a frame extending from said base, said base having a passage extending therethrough defining an inlet and an outlet; a deflector mounted to said frame and spaced from said outlet, said deflector being configured to deflect fluid flowing from said outlet in a radial pattern; a trigger assembly adapted to seal said outlet and release said seal when a temperature associated with a fire condition is detected; and said deflector comprising:

a generally planar circular member and includes a plurality of slots extending into said circular member from an outer perimeter edge of said circular member, each of said slots being aligned with and extended along a respective radius of said circular member, each slot having a lateral dimension extending generally perpendicular to its respective radius of said circular member and an end with a radius of curvature, a first group of said slots having larger or smaller lateral dimensions than a second group of said slots, and said first group of said slots having ends with larger or smaller radii than said second group, wherein each slot has a longitudinal dimension extending along its respective radius of said circular member, said first group of said slots having greater longitudinal dimensions than said second group of said slots, wherein said first group of said slots and said second group of slots have greater longitudinal dimensions than a third group of said slots.

* * * * *

UNITED STATES PATENT AND TRADEMARK OFFICE

CERTIFICATE OF CORRECTION

PATENT NO. : 7,314,093 B2
APPLICATION NO. : 11/056797
DATED : January 1, 2008
INVENTOR(S) : Shawn G. Orr It is certified that error appears in the above-identified patent and that said Letters Patent is hereby corrected as shown below:

Col. 3, line 1, after “FIG. 15 is” insert --a--.

Col. 3, line 58, delete “form” and insert --from-- therefor.

Col. 4, line 16, delete the first occurrence of “a”.

Col. 5, line 11, delete “that” and insert --than-- therefor.

Col. 6, line 9, delete “assemblies” and insert --assembly-- therefor.

Signed and Sealed this

Twenty-ninth Day of July, 2008

JON W. DUDAS
*Director of the United States Patent and Trademark Office*